US009308631B2

(12) United States Patent
Shyu

(10) Patent No.: US 9,308,631 B2
(45) Date of Patent: Apr. 12, 2016

(54) BARREL TYPE RATCHET WRENCH WITH A SNAP-IN STRUCTURE

(71) Applicant: Jun-Tsai Shyu, Taichung (TW)

(72) Inventor: Jun-Tsai Shyu, Taichung (TW)

( * ) Notice: Subject to any disclaimer, the term of this patent is extended or adjusted under 35 U.S.C. 154(b) by 246 days.

(21) Appl. No.: 14/195,818

(22) Filed: Mar. 3, 2014

(65) Prior Publication Data

US 2015/0246434 A1 Sep. 3, 2015

(51) Int. Cl.
*B25B 23/00* (2006.01)
*B25B 13/46* (2006.01)
*B25B 15/04* (2006.01)

(52) U.S. Cl.
CPC ..... *B25B 23/0035* (2013.01); *B25B 13/463* (2013.01); *B25B 13/465* (2013.01); *B25B 15/04* (2013.01)

(58) Field of Classification Search
CPC ..... B25B 23/0035; B25B 13/463
USPC ..... 81/60–63.2
See application file for complete search history.

(56) References Cited

U.S. PATENT DOCUMENTS 2,636,411 A * 4/1953 Wood ..... B25B 13/463 81/58.2
3,009,372 A * 11/1961 Kostka ..... B25B 13/462 81/58.4
4,703,676 A * 11/1987 Mayer ..... B25B 13/463 81/63
5,193,419 A * 3/1993 Lee ..... B25G 1/043 403/324
6,065,374 A * 5/2000 Taggart ..... B25B 13/463 81/63
6,516,689 B1 * 2/2003 Bates ..... B25B 13/463 81/58
6,789,449 B2 * 9/2004 Liu ..... B25B 13/463 192/43
7,331,259 B1 * 2/2008 Chen ..... B25B 13/463 81/57
7,823,484 B1 * 11/2010 Chen ..... B25B 13/463 81/177.9
8,943,929 B2 * 2/2015 Ou ..... B25B 13/463 81/60
2002/0017169 A1 * 2/2002 Hu ..... B25B 13/463 81/63.1
2011/0132149 A1 * 6/2011 Lee ..... B25B 13/463 81/63.1
2013/0228048 A1 * 9/2013 Lai ..... B25B 13/462 81/63.1

* cited by examiner

*Primary Examiner* — Hadi Shakeri
*Assistant Examiner* — Danny Hong

(57) ABSTRACT

A barrel type ratchet wrench with a snap-in structure, including a ratchet acting head installed at a wrench body, a shallow groove formed at a position adjacent to a hollow barrel and having a positioning bolt hole formed at the center of the shallow groove for plugging a direction switching button and a positioning bolt of a ratchet module. A snap plate with an appearance similar to the profile of the shallow groove and having a snap portion, a long hole and a pushing portion is installed under the direction switching button, and a collar having a containing hole corresponsive to a locking component is disposed at the wrench body proximate to the ratchet acting head for containing an elastic member, and the pushing portion of the snap plate has a corresponding end plugged into the containing hole and normally abutted by the elastic member. The snap portion of the snap plate is extended into an edge of the hollow barrel of the ratchet acting head and embedded into a corresponding ring groove of the external socket and the external adapter to prevent unexpected separations.

1 Claim, 5 Drawing Sheets

BARREL TYPE RATCHET WRENCH WITH A SNAP-IN STRUCTURE

BACKGROUND OF THE INVENTION

1. Fields of the Invention

The present invention relates to a barrel type ratchet wrench with a snap-in structure, and more particularly to the snap-in structure capable of latching an external socket with an external adapter to prevent them from falling out unexpectedly or affecting the normal smooth operation of the wrench.

2. Description of the Related Art

The ratchet wrench refers to a professional wrench having a ratchet direction controlling mechanism for controlling the driving direction to apply a force, and barrel type ratchet wrench refers to a wrench having a ratchet acting head designed as a hollow barrel provided for plugging a component module such as an external socket or an external adapter (similar to the component module as shown in FIGS. 6 and 7) and controlling the rotation direction of a screw (not shown in the figure).

Although the conventional barrel type ratchet wrench has been used for years and common to users, yet the connection between the external socket and the external adapter with the hollow barrel is simply by abutting a top bead (installed on a side of the external socket and the external adapter) or latching a ring (installed at an inner periphery of the hollow barrel), so that the two produce a combining strength of a certain level and will not be separated easily. As we all know, the wrench probably hits a surrounding object or the operator moves too much in the process of applying a force for the operation of the wrench, so that the external socket and the external adapter may be separated from the hollow barrel easily, and the operation or construction may be affected adversely, or the external socket and external adapter may even be lost or missing, and thus resulting gin an unexpected difficult situation. Obviously, the conventional design requires further improvements.

SUMMARY OF THE INVENTION

It is a primary object of the present invention to prevent the external socket and the external adapter from being separated from the wrench unexpectedly, so as to achieve the effects of maintaining a smooth operation of the construction effectively, preventing unnecessary losses caused by any unsmooth operation, and enhancing the practicality of the wrench to overcome the aforementioned problems. A second object of the invention is to provide an assembly element of a hand tool that includes more than one annular groove formed in the largest portion thereof as an identification label for an easy identification of the item number, size, type, etc.

According to the invention, a barrel type ratchet wrench with a snap-in structure, including a ratchet acting head installed at a wrench body, a shallow groove formed at a position adjacent to a hollow barrel and having a positioning bolt hole formed at the center of the shallow groove for plugging a direction switching button and a positioning bolt of a ratchet module. A snap plate with an appearance similar to the profile of the shallow groove and having a snap portion, a long hole and a pushing portion is installed under the direction switching button, and a collar having a containing hole corresponsive to a locking component is disposed at the wrench body proximate to the ratchet acting head for containing an elastic member, and the pushing portion of the snap plate has a corresponding end plugged into the containing hole and normally abutted by the elastic member. The snap portion of the snap plate is extended into an edge of the hollow barrel of the ratchet acting head and embedded into a corresponding ring groove of the external socket and the external adapter to prevent unexpected separations.

BRIEF DESCRIPTION OF THE DRAWINGS

The accomplishment of this and other objects of the invention will become apparent from the following description and its accompanying drawings of which.

DETAILED DESCRIPTION OF THE PREFERRED EMBODIMENT

The present invention will now be described in more detail hereinafter with reference to the accompanying drawings that show various embodiments of the invention.

Figure 1:
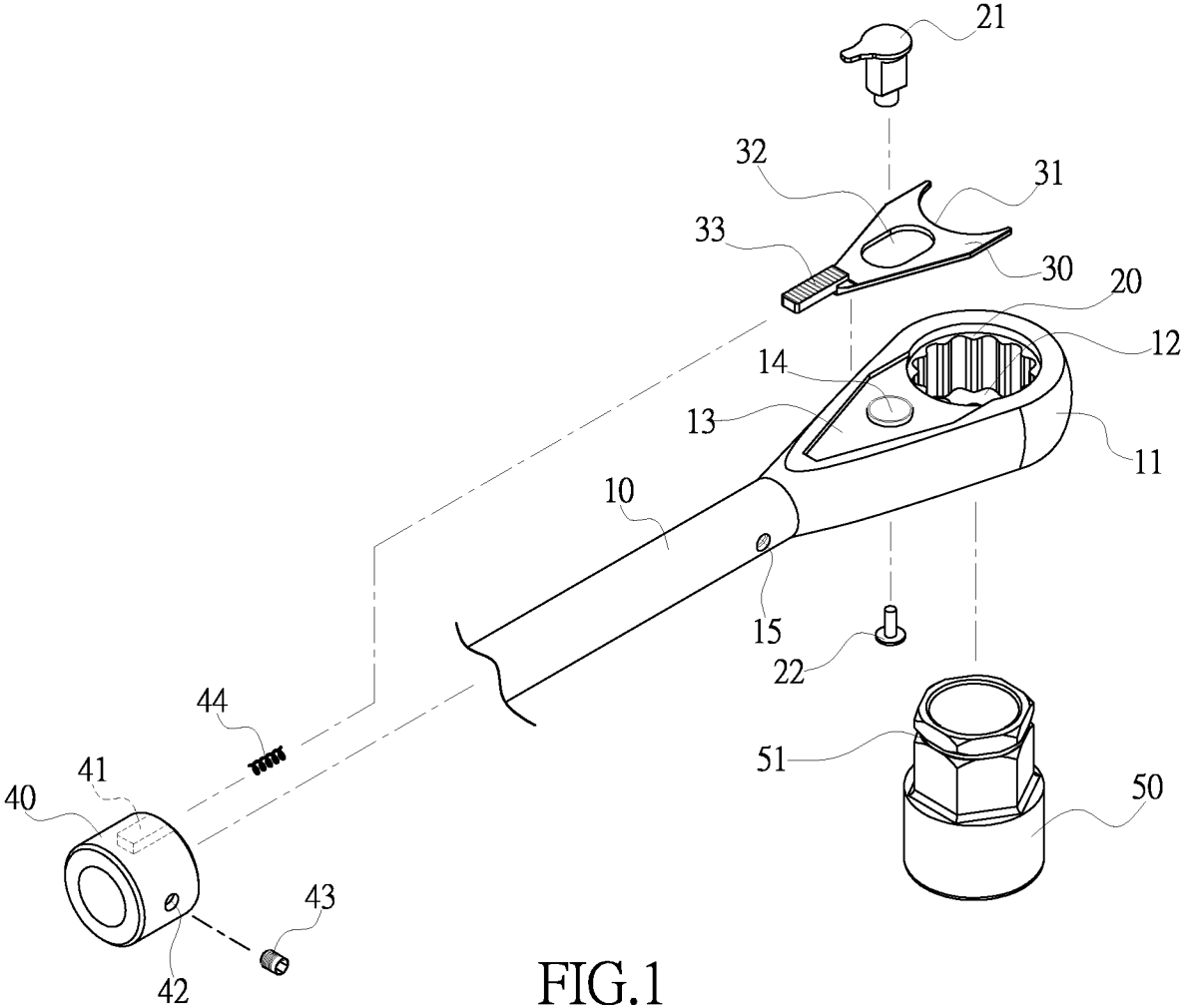
FIG. 1 is an exploded view of a preferred embodiment of the present invention.
Figure 2:
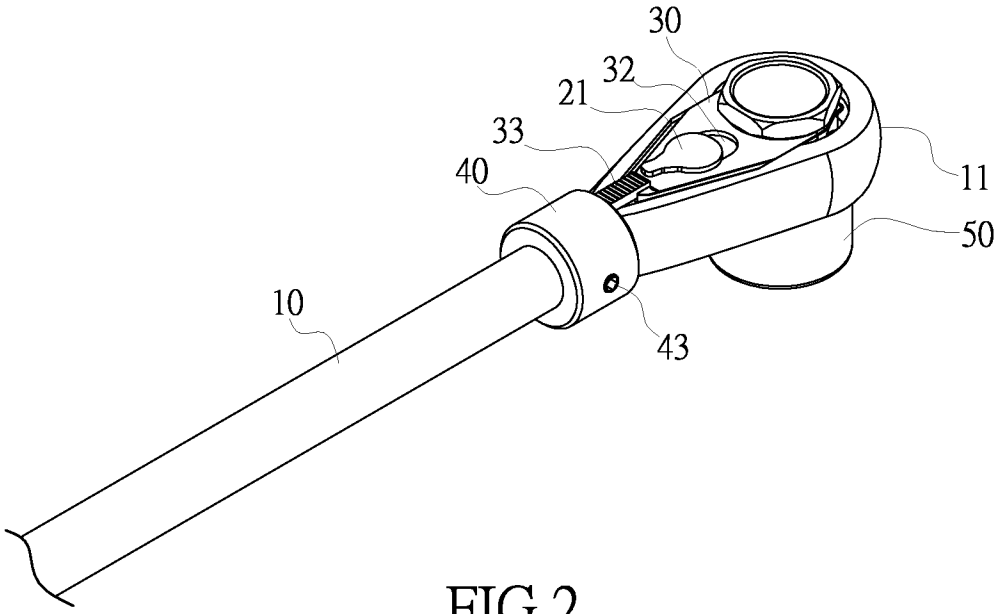
FIG. 2 is a perspective view of the assembly as depicted in FIG. 1.
Figure 3:
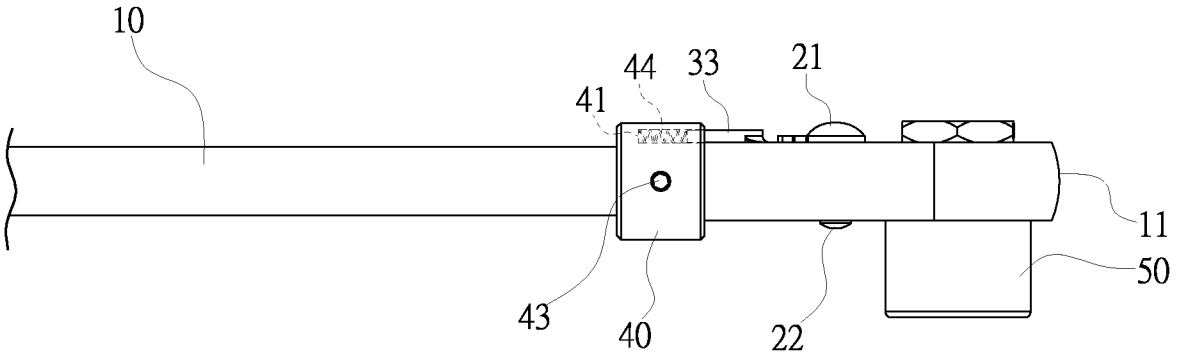
FIG. 3 is a schematic view of the assembly as depicted in FIG. 1.

With reference to FIGS. 1 to 3 for a preferred embodiment of the present invention, the embodiment comprises a wrench body 10, a snap plate 30 and a collar 40.

The wrench body 10 has a ratchet acting head 11 of a ratchet module 20 disposed at an end of the wrench body 10, a hollow barrel 12 installed at an appropriate position of the ratchet acting head 11, a shallow groove 13 formed on a side adjacent to the hollow barrel 12 and having a positioning bolt hole 14 formed at the center of the shallow groove 13 for plugging a direction switching button 21 and a positioning bolt 22 of the ratchet module 20.

The snap plate 30 with an external shape similar to the profile of the shallow groove 13 is installed under the direction switching button 21 and disposed horizontally in the shallow groove 13. The snap plate 30 includes a snap portion 31, a long hole 32 and a pushing portion 33.

The collar 40 is locked to a screw hole 15 of the wrench body 10 proximate to the ratchet acting head 11 to match a locking component 43 and a corresponding hole position 42, and the collar 20 has a containing hole 41 for containing an elastic member 44, and the pushing portion 33 of the snap plate 30 has a corresponding end plugged into the containing hole 41 and normally abutted by the elastic member 44.

Figure 4:
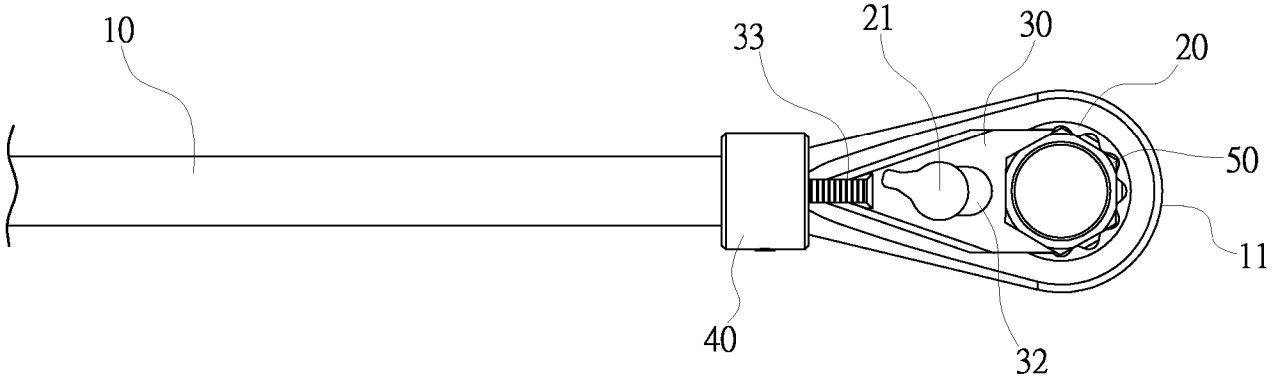
FIG. 4 is a top view of FIG. 3.
Figure 5:
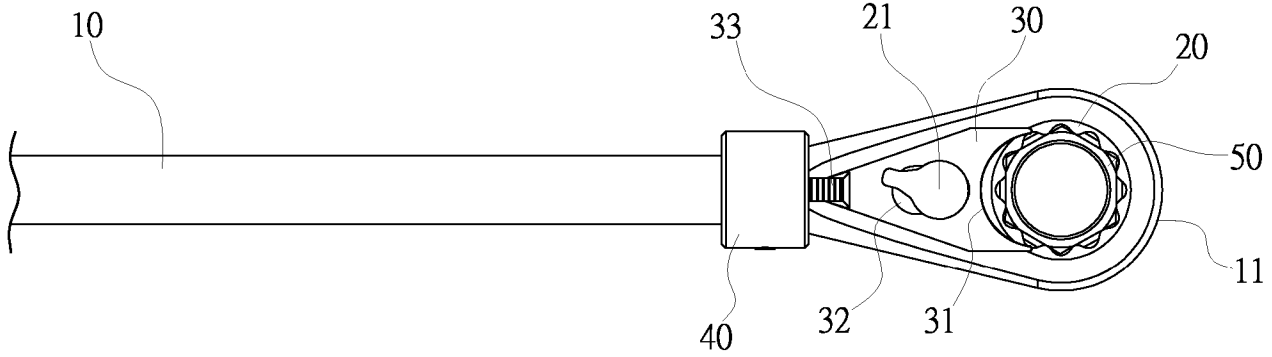
FIG. 5 is a schematic view of the operation of the assembly as depicted in FIG. 4.

With the aforementioned components as shown in FIGS. 4 and 5, the snap portion 31 of the snap plate 30 may be plugged into an edge of the hollow barrel 12 of the ratchet acting head 11, so that after an external socket 50 is plugged into the hollow barrel 12, the hollow barrel 12 is embedded into a corresponding ring groove 51 of the external socket 50 securely, and the external socket 50 will not fall out from the hollow barrel 12 unexpectedly. If it is necessary to remove the external socket 50, the external socket 50 is acted by the pushing portion 33 of the snap plate 30 and pushed in an opposite direction (See FIG. 5), so that the snap portion 31 of the snap plate 30 is separated from the ring groove 51 of the external socket 50, and the external socket 50 can be removed, installed, or replaced easily. Particularly, the displacement of the snap plate 30 will not affect the operation and control of the ratchet module 20 and the direction switching button 21.

Since the ratchet module 20 and its direction switching button 21 and positioning bolt 22 are conventional components, they will not be described in details here.

Figure 7:
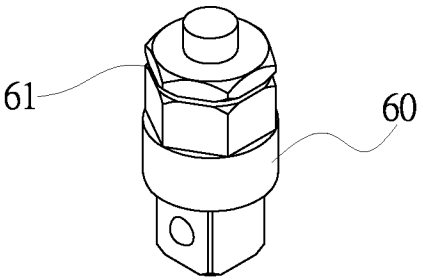
FIG. 7 is a schematic perspective view of an external adapter.
Figure 6:
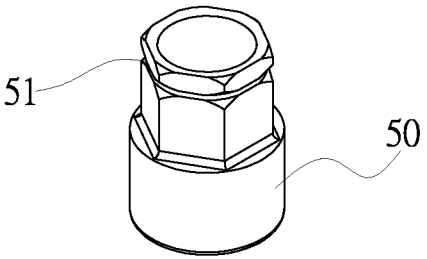
FIG. 6 is a schematic perspective view of an external socket.

With reference to FIGS. 6 and 7, the external socket 50 of the present invention is substituted by an external adapter 60, and both external socket 50 and external adapter 60 are corresponsive to the snap portion 31 of the snap plate 30 and latched into the ring grooves 51, 61.

Many changes and modifications in the above-described embodiments of the invention can, of course, be carried out without departing from the scope thereof. Accordingly, to promote the progress in science and the useful arts, the invention is disclosed and is intended to be limited only by the scope of the appended claims.

What is claimed is:

1. A barrel type ratchet wrench with a snap-in structure, comprising:

a wrench body, having an end which is a ratchet acting head having a ratchet module, a hollow barrel disposed at an appropriate position of the ratchet acting head, a shallow groove formed on a side adjacent to the hollow barrel, and a positioning bolt hole formed at the center of the shallow groove for plugging a direction switching button and a positioning bolt of the ratchet module;

a snap plate, with an appearance similar to the profile of the shallow groove, installed under the direction switching button, and horizontally installed in the shallow groove, and having a snap portion, a long hole and a pushing portion; and a collar, locked to a screw hole of the wrench body proximate to the ratchet acting head to match as locking component and a corresponding hole position, and having a containing hole formed on the collar for containing an elastic member, and the pushing portion of the snap plate having a corresponding end plugged into the containing hole and normally abutted by the elastic member.

* * * * *